US006722283B1

(12) United States Patent
Dindl et al.

(10) Patent No.: US 6,722,283 B1
(45) Date of Patent: Apr. 20, 2004

(54) CONTROLLED TERMINAL KINETIC ENERGY PROJECTILE

(75) Inventors: Frank J. Dindl, Newton, NJ (US); Curtis D. Johnson, Montrose, PA (US); Piotr Frey, Hopatcong, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 52 days.

(21) Appl. No.: 10/249,794

(22) Filed: May 8, 2003

Related U.S. Application Data

(60) Provisional application No. 60/319,958, filed on Feb. 19, 2003.

(51) Int. Cl.[7] ..... F42B 8/00

(52) U.S. Cl. ..... 102/489; 102/502; 102/513; 102/501; 102/370

(58) Field of Search ..... 102/489, 502, 102/517, 501, 513, 529, 367, 370

(56) References Cited

U.S. PATENT DOCUMENTS 1,741,901 A * 12/1929 Alden ..... 102/502
4,173,930 A * 11/1979 Faires, Jr. ..... 102/529
4,949,644 A * 8/1990 Brown ..... 102/501
6,283,037 B1 * 9/2001 Sclafani ..... 102/502

FOREIGN PATENT DOCUMENTS

EP 103509 A1 * 3/1984 ..... 102/501

* cited by examiner

*Primary Examiner*—Michael J. Carone
*Assistant Examiner*—L. Semunegus
(74) *Attorney, Agent, or Firm*—Michael C. Sachs; John F. Moran

(57) ABSTRACT

A non-lethal projectile includes a projectile body; a fuze disposed in a rear of the projectile body; an expelling charge disposed adjacent the fuze; a wad disposed adjacent the expelling charge; a dense powder ballast disposed adjacent the wad; a non-lethal payload disposed adjacent the dense powder ballast; and an end cap disposed on a front end of the projectile body; wherein the expelling charge expels the dense powder ballast and non-lethal payload and reduces the forward kinetic energy of the projectile body and the fuze to one of a near non-lethal or non-lethal level such that as the projectile body and the fuze travel from a burst point to a target impact a residual kinetic energy of the projectile body and the fuze is non-lethal.

8 Claims, 2 Drawing Sheets

2001-025

2001-025

CONTROLLED TERMINAL KINETIC ENERGY PROJECTILE

CROSS REFERENCE TO RELATED APPLICATIONS

This application claims the benefit of priority of U.S. provisional patent application Ser. No. 60/319,958 filed on Feb. 19, 2003, which application is expressly incorporated by reference.

BACKGROUND OF INVENTION

The present invention relates in general to non-lethal ammunition and in particular to non-lethal ammunition that are launched with a relatively high kinetic energy compared to conventional non-lethal ammunition.

Non-lethal ammunition is typically launched with a kinetic energy that will produce non-lethal effects upon target impact. Weapons such as the Objective Individual Combat Weapon are designed to fire projectiles with kinetic energies far greater than non-lethal projectiles of the same caliber. The weapon operating system and fire control are designed to function with projectiles which have a specific recoil impulse and trajectory. There is a great and still unsatisfied need for firing non-lethal ammunition from weapons such as the Objective Individual Combat Weapon. The recoil impulse and trajectory of the non-lethal ammunition needs to be compatible with the standard combat ammunition recoil impulse and trajectory to fully utilize the weapon's capabilities.

SUMMARY OF INVENTION

One feature of the present invention is to satisfy this long felt need to provide a non-lethal ammunition with a recoil impulse and trajectory that is compatible with conventional combat ammunition. The present invention accomplishes this by using a projectile of an equivalent mass, muzzle velocity and trajectory to achieve weapon powering and provide compatibility with the sighting system.

The present invention also uses a bursting charge and dense powder payload to control the kinetic energy of the residual projectile components upon projectile detonation at the appropriate burst point from the target. The burst charge increases the forward momentum of the dense powder payload and non-lethal payload while decreasing the forward momentum of the residual projectile components. This momentum exchange produces a residual projectile component kinetic energy that is at a level which will produce non-lethal effects should any of the residual projectile components strike the target. The kinetic energy of the dense powder is rapidly dissipated due to the high aerodynamic drag characteristics of the powder. The non-lethal payload may also posses a lethal kinetic energy that is reduced to a non-lethal level by aerodynamic drag as the non-lethal payload passes from the projectile burst point to target impact.

The inventive projectile configuration allows high velocity, high kinetic energy projectiles to be launched from weapons such as the 20 mm Objective Individual Combat Weapon; 25 mm Objective Crew Served Weapon; 40 mm M203 grenade launcher; 40 mm MK19 grenade machine gun; 105 mm and 155 mm artillery; 60 mm, 81 mm and 120 mm mortars; 2.75 inch rockets; 12 gauge shotguns; and other weapons and calibers, while producing non-lethal effects at the target. The invention allows high velocity, long range and precision delivery of non-lethal payloads without the need to modify the weapon or sighting system.

BRIEF DESCRIPTION OF DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion, and are shown for visual clarity and for the purpose of explanation.

DETAILED DESCRIPTION

The embodiments described herein are included for the purposes of illustration, and are not intended to be the exclusive; rather, they can be modified within the scope of the invention. Other modifications may be made when implementing the invention for a particular application.

The present invention is a non-lethal projectile for weapons such as the Objective Individual Combat Weapon wherein the projectile muzzle velocity, recoil impulse and trajectory are compatible with the weapon mechanism and sighting system, without modification to the weapon. The non-lethal projectile includes a fuze, an expelling charge, a dense powder ballast and a non-lethal payload. The fuze determines the projectile burst point and initiates the expelling charge. The expelling charge projects the dense powder ballast and non-lethal payload forward while at the same time reducing the forward momentum, velocity and kinetic energy of the residual projectile components.

The high aerodynamic drag characteristics of the dense powder ballast allows the kinetic energy of the dense powder to be reduced to a non-lethal level prior to reaching the target. The aerodynamic drag of the non-lethal payload also allows the kinetic energy of the non-lethal payload to be reduced to the required non-lethal level prior to target impact. The projectile configuration allows the use of a high velocity, high kinetic energy projectile to provide precision delivery of a non-lethal payload while reducing the kinetic energy of the payload and residual projectile components to a non-lethal level at target impact.

Figure 1:
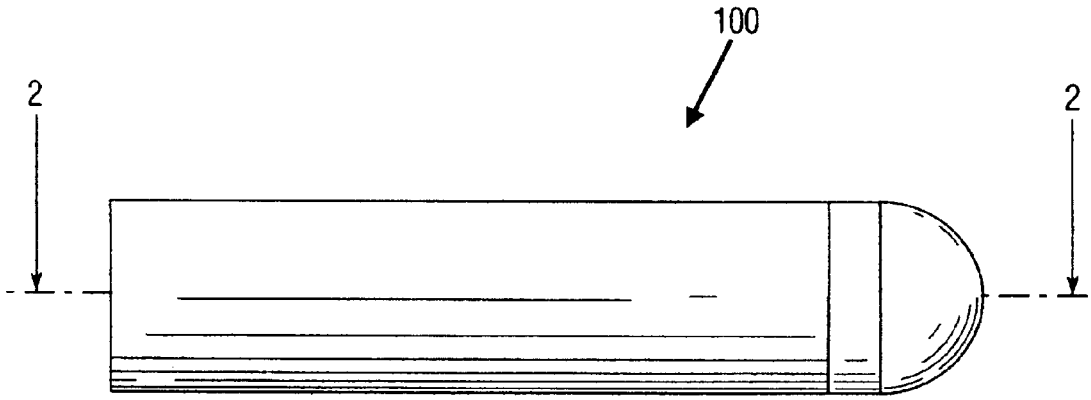
FIG. 1 is a side elevation view of a controlled terminal kinetic energy projectile at muzzle exit.
Figure 2:
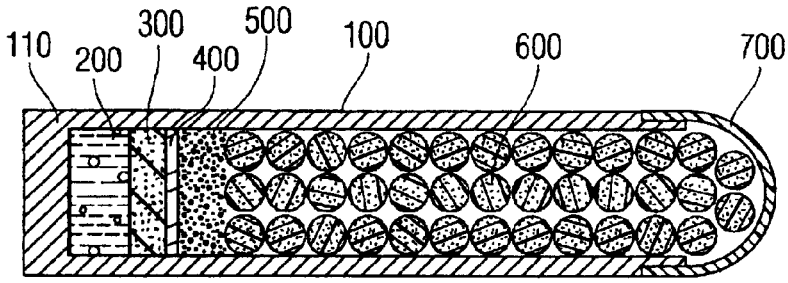
FIG. 2 is a cross-sectional view of the controlled terminal kinetic energy projectile taken along the line 2—2 of FIG. 1, where the dense powder ballast is located behind the payload.
Figure 3:
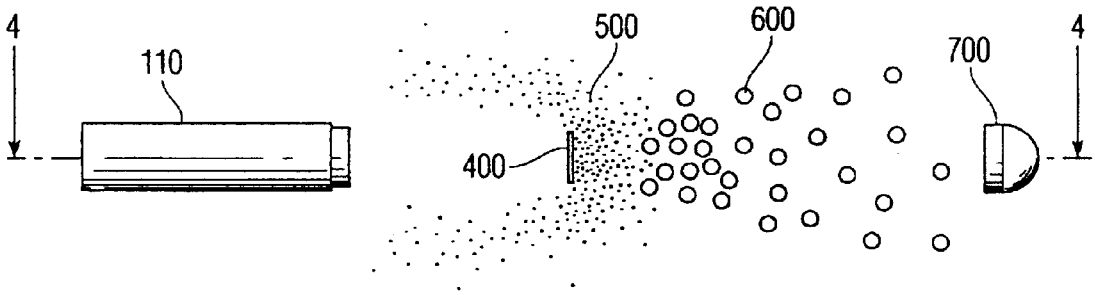
FIG. 3 is a side elevational view of a controlled terminal kinetic energy projectile at projectile burst point.
Figure 4:
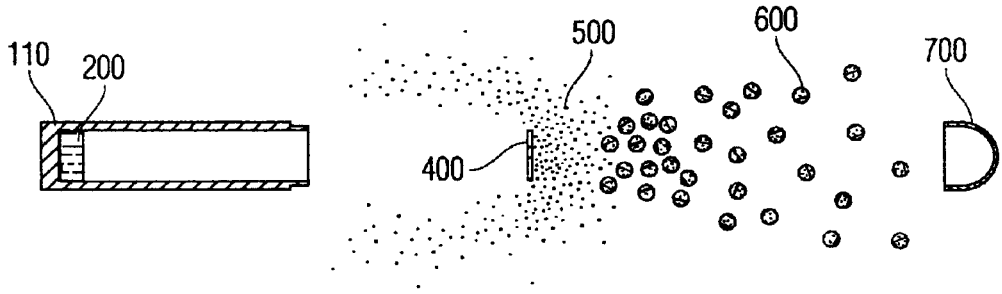
FIG. 4 is a cross-sectional view of the controlled terminal kinetic energy projectile taken along the line 4—4 of FIG. 3.

A controlled terminal kinetic energy projectile 100 according to a first embodiment of the present invention is depicted in FIGS. 1 through 4. FIG. 1 is a side elevation view of a controlled terminal kinetic energy projectile 100 at muzzle exit. FIG. 2 is a cross-sectional view of the controlled terminal kinetic energy projectile taken along the line 2—2 of FIG. 1, where the dense powder ballast is located behind the payload.

As best seen in FIG. 2, the projectile 100 generally comprises a projectile body 110, a fuze 200, a propellant or expelling charge 300, a wad 400, a dense powder ballast 500, a payload 600, and an end cap 700. The projectile body 110 is made of, for example, a metal such as aluminum or steel. The end cap 700 is made of, for example, a plastic such as polyethylene, nylon or ABS. The expelling charge 300 comprises for example, a nitrocellulose propellant. The dense powder ballast 500 comprises, for example, tungsten powder, iron filings, powdered lead or sand. A typical density for tungsten powder is about 10 grams per cubic centimeter. The non-lethal payload 600 may comprise conventional non-lethal payloads in the form of, for example a liquid, solid, powder or aerosol. Examples of the non-lethal payload 600 include riot control agents such as tear gas or pepper spray, flash bang charges and blunt impact rubber projectiles.

The projectile 100 is launched in the same manner as a full service combat round of the same caliber. That is, the projectile 100 is the leading or front portion of a conventional cartridge (not shown). The fuze 200 initiates the expelling charge 300 at the appropriate stand off distance from the target. The expelling charge 300 forces the wad 400, dense powder ballast 500, payload 600, and end cap 700 forward, out the end of the projectile body 110 (See FIGS. 3 and 4). This expulsion results in a momentum exchange between the expelled components (i.e., the wad 400, the dense powder ballast 500, the payload 600 and the end cap 700) and a decreased forward momentum of the residual components (i.e., the projectile body 110 and the fuze 200).

The reduced momentum of the residual components, aerodynamic instability, and increased drag during the remainder of the flight towards the target further reduces the kinetic energy of the residual components (i.e., the projectile body 110 and the fuze 200) to a level which will produce non-lethal effects should they strike the target. The kinetic energy of the expelled components (400, 500, 600, and 700) is initially increased as a result of expulsion. The low mass aerodynamic instabilities and high aerodynamic drag characteristics of the expelled components (400, 500, 600 and 700) result in their rapid deceleration to non-lethal energy levels during the remainder of the fight to target impact.

The dense powder ballast 500 performs several functions. It is employed to tailor the total mass of the expelled components (400, 500, 600, and 700) such that the residual components (110 and 200) may be adequately decelerated to a non-lethal level using a practical expelling charge 300. The dense powder ballast 500 is used in producing a total projectile mass equivalent to combat projectiles of the same caliber. Further, it allows tailoring the projectile mass distribution to achieve aerodynamic stability. The high density of the density powder ballast 500 requires minimal space for a given projectile size, thereby allowing more room for the non-lethal payload 600.

The initial launch characteristics of the projectile 100 are equivalent to those of conventional combat ammunition. Therefore, components of combat weapon systems such as the operating mechanism of individual combat weapons and fire control solutions are directly compatible with the present invention.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A non-lethal projectile, comprising:

a projectile body;

a fuze disposed in a rear of the projectile body;

an expelling charge disposed adjacent the fuze;

a wad disposed adjacent the expelling charge;

a dense powder ballast disposed adjacent the wad;

a non-lethal payload disposed adjacent the dense powder ballast; and an end cap disposed on a front end of the projectile body;

wherein the expelling charge expels the dense powder ballast and non-lethal payload and reduces the forward kinetic energy of the projectile body and the fuze to one of a near non-lethal or non-lethal level such that as the projectile body and the fuze travel from a burst point to a target impact a residual kinetic energy of the projectile body and the fuze is non-lethal.

2. The non-lethal projectile of claim 1 wherein the projectile body comprises a metal.

3. The non-lethal projectile of claim 2 wherein the metal comprises one of aluminum and steel.

4. The non-lethal projectile of claim 1 wherein the end cap comprises plastic.

5. The non-lethal projectile of claim 1 wherein the expelling charge comprises a nitrocellulose propellant.

6. The non-lethal projectile of claim 1 wherein the dense powder ballast comprises at least one of tungsten, iron, lead and sand.

7. The non-lethal projectile of claim 6 wherein a density of the dense powder ballast is about 10 grams per cubic centimeter.

8. The non-lethal projectile of claim 1 wherein the non-lethal payload comprises at least one of a liquid, solid, powder and aerosol.

* * * * *